US006729293B2

(12) United States Patent
Shifflette

(10) Patent No.: US 6,729,293 B2
(45) Date of Patent: May 4, 2004

(54) METHOD AND APPARATUS FOR VENTING EXCESSIVE CYLINDER PRESSURE

(76) Inventor: J. Michael Shifflette, 5900 SW. 196th La., Fort Lauderdale, FL (US) 33332

( * ) Notice: Subject to any disclaimer, the term of this patent is extended or adjusted under 35 U.S.C. 154(b) by 253 days.

(21) Appl. No.: 10/028,511

(22) Filed: Dec. 20, 2001

(65) Prior Publication Data

US 2003/0116111 A1 Jun. 26, 2003

(51) Int. Cl.[7] ..... F02B 77/00
(52) U.S. Cl. ..... 123/198 D
(58) Field of Search ..... 123/198 D

*Primary Examiner*—Noah P. Kamen
(74) *Attorney, Agent, or Firm*—Michael C Cesarano; Akerman Senterfitt

(57) ABSTRACT

An apparatus for releasing excessive pressure from a cylinder of an internal combustion engine comprises a sealing element inserted into a passageway that extends from an internal surface of the cylinder through the engine block or cylinder head to end at a point of ambient air pressure. The sealing element is thermally responsive and will release to cause the passageway to form a vent passage between the cylinder and the ambient air upon the occurrence of any one of a number of conditions of excessive pressure and temperature in the cylinder.

25 Claims, 5 Drawing Sheets

METHOD AND APPARATUS FOR VENTING EXCESSIVE CYLINDER PRESSURE

BACKGROUND OF THE INVENTION

The deleterious effects of detonation and hydrolock are well documented. Hydrolock is a condition in which water, oil, fuel, or some other incompressible liquid may be ingested or otherwise introduced into an engine cylinder, with the consequence of reducing the volume available in the cylinder within which air may be compressed when the engine is running. The reduction in cylinder volume available for air compression causes compression within the cylinder to reach higher-than-normal operating pressure and, in extreme cases, may cause internal components to fail. Hydrolock is most commonly experienced in conditions of extreme wetness, such as passenger automobiles driving upon flooded city streets, all terrain vehicles operating in swamp or river conditions, and watercraft operating in marine environments. Less well known, however, is the incidence of hydrolock in aircraft engines, particularly in radial-style engines in which one or more cylinders are oriented "upside down," with the cylinder head being lower than the head of the piston, when the aircraft is in its normal "upright" position. When a radial engine has been at rest for more than a few hours, oil and fuel may trickle down to the lowest point, which may be at the extreme "upper" end of one of the "upside down" cylinders, thereby reducing the cylinder volume available for the fuel-air mixture. If the engine should thereafter be started, compression within those cylinders may exceed design parameters and engine components may be bent or severely weakened. Although the engine damage may not immediately be evident, those components may thereafter fail during normal flight, resulting in an airborne engine failure and a life threatening emergency. Instances of hydrolock in other vehicles may be less serious, from a survival perspective, but nevertheless can result in extreme inconvenience if engine failure should occur at a location that is remote from engine repair or tow facilities. At a minimum, a hydrolock-induced engine failure will normally require an expensive engine rebuild.

Detonation is conceptually different from hydrolock, yet may produce a similar condition of excessive cylinder pressure that could damage engine components. Detonation occurs when the temperature within a cylinder causes the fuel-air mixture to auto-ignite whereupon the fuel-air mixture does not burn with a propagating wave front, but literally explodes, causing an instantaneous rise, then fall, in temperatures and pressures. Where the fuel-air mixture does not burn so as to propagate a moving wave front, the energy of the chemical reaction is dissipated before the piston can respond, and the energy available to force the piston downward is lost to irreversibilities including heat transfer and sound generation. The causes for this condition may vary from such conditions as an improper fuel-air mixture to a timing failure that causes a premature spark from the spark plug. Detonation has also been identified as a cause of aircraft engine failures, particularly where the fuel-air mixture, which may be controlled by the pilot, is set to run too lean when the aircraft is at cruise altitude. As with hydrolock, a detonating aircraft engine may fail during flight, again giving rise to an emergency of life-threatening proportions. A common result of detonation is excessive temperature that causes damage to the piston, rings, and valves, and excessive pressure.

One method of relieving excessive pressure in an engine cylinder is to allow pressure to vent through a deformable spark plug. As the temperature and pressure combine to create destructive conditions within a cylinder, a specially designed portion of the spark plug gives way to form a vent passage to the atmosphere, thereby allowing the excessive pressure to dissipate before components fail. This system is exemplified in U.S. Pat. No. 5,799,634 to Shifflette, entitled Spark Plug for Venting Excessive Pressure. The solution provided by Shifflette works well in environments in which the vent passage provided by the spark plug deformation is satisfactory both in size and location. That system, however, is not suitable for use in internal combustion engines that do not use a spark plug, nor in situations in which a larger or smaller hole than is provided by a spark plug is desired. In addition, when the spark plug of Shifflette deforms, the solid ejected portion may present an undesirable condition, either by being uncontrollably released within an engine compartment, or in extreme circumstances, penetrating the walls of the engine compartment and being released as a flying object that could cause damage external to the engine compartment. Another drawback is that the vent passage through a spark plug could vent cylinder contents against some other critical engine component such as a spark plug wire leading to another cylinder, a fuel line, a throttle linkage, or the like. Because spark plugs are normally installed with turning wrenches, it may not be possible to predict in advance the final orientation of the spark plug, hence the direction in which cylinder contents will vent. Where a vent passage has been created, it is possible that hot cylinder gases may be discharged against other critical components, causing those components to fail. Accordingly, what is needed is a cylinder pressure release system that is responsive to excessive engine pressures and temperatures, and that is able to be positioned wherever desired within an engine cylinder.

SUMMARY OF THE INVENTION

In accordance with this invention, a venting passageway may be created having an internal terminus within an engine cylinder and extending through the surrounding material in which the cylinder is formed, either the engine block or cylinder head. The external terminus of the passageway may be located within an engine cavity, such as, for example, an exhaust port, or may be located at an external surface of the engine. The external terminus will preferably be situated in a location where ejected solids may be contained and controlled. The passageway is hermetically closed with a mechanical sealing element of known strength and temperature limits. The sealing element may have component parts or an internal structure, and is responsive to pressure and temperature developed with the cylinder. The sealing element may be secured within the passageway by any one of a variety of sealing mechanisms including a press fit, a threaded shaft, a keyed shaft, a glue, epoxy, or other adhesive, or by other, equivalent securing means known within the art. As used herein, the term "sealing element" refers to the device used to seal the vent passageway and also includes securing means. Under conditions of excessive temperature, the sealing element, or portions thereof, will weaken to reduce the threshold pressure that will be required to create a vent passageway through the element. At any given temperature, cylinder pressure which stresses the sealing element beyond its strength will cause the sealing element to deform or dislodge such that the passage remains open thereafter. Combinations of cylinder temperature, combustion gas temperature, and combustion pressure may also act collectively or individually to cause the sealing element to release and allow venting of the passageway. As used herein, all designed failure modes of a sealing element to create an opening in the passageway sufficient to vent cylinder contents shall be referred to as a "release." Because a pressure relief passageway protects only a single cylinder, detonation in that cylinder may be prevented while still permitting acceptable power output from the remaining cylinders in a multiple cylinder engine. In all cases, after the sealing element has released, the engine may be restored to full functionality simply be replacing the sealing element with a new sealing element in the vent passageway and correcting the condition that caused the passageway to open.

DETAILED DESCRIPTION OF THE PREFERRED EMBODIMENTS

Figure 1:
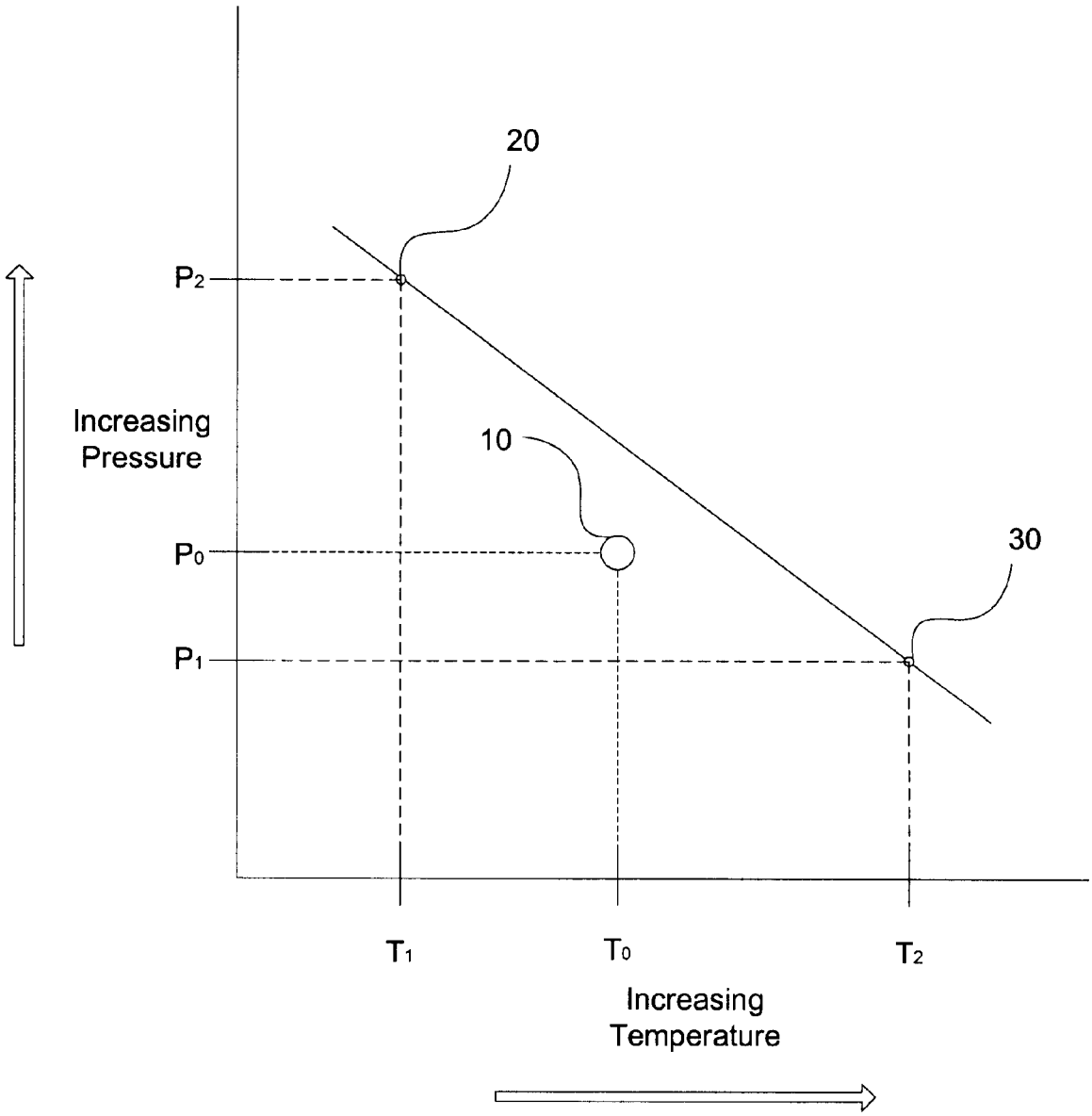
FIG. 1 is an exemplary graphical depiction of the failure mode of the sealing element of this invention as a function of cylinder pressure and temperature.

As shown in FIG. 1, the failure mode of the sealing element of this invention is graphically shown as a function of peak cylinder pressures and temperatures. As earlier noted herein, references to the "release" of the sealing element mean that the sealing element performs as intended, and either deforms or dislodges to create a vent passageway when exposed to abnormal cylinder conditions of temperature or pressure or both. A region of normal operating temperature and pressure is indicated at 10, it being understood that this point represents normal temperatures and pressures in an engine that has "warmed up," and is operating within its design parameters.

At one end of the pressure-temperature spectrum 20, the sealing element should release simply as a result of excessive pressure being developed in a "cold" cylinder. In this environment, excessive pressure in the absence of high temperatures, such as could be encountered when attempting to start a cold engine having a hydrolocked cylinder, for example, will cause the sealing element to release simply because excessive pressure is applied to the sealing element. For this release mode, the sealing element should be designed so that the "cold" release pressure for the sealing element will occur at pressures below those that would weaken other cylinder components. At the other end of the spectrum 30, it is desirable that an abnormally high temperature will cause a sealing element to release at a pressure that is lower than normal. For this release mode, the sealing element is designed so that excessive cylinder temperatures will temporarily weaken the sealing element, effectively lowering the threshold pressure at which the sealing element will release. This release mode could activated, for example, when a cylinder generates higher than normal temperatures associated with detonation that act upon the sealing element. Where a cylinder abnormality is associated with temperature, it is desirable to have the cylinder start venting at a lower pressure threshold than would be the case for a normally operating engine.

The graph depicted in FIG. 1 is generally linear, and provides a continuum of temperature and pressure combinations that will cause the sealing element to release. It will be understood, however, that the specific shape of a graph for a particular design of sealing element may not be linear, and will depend upon the particular components and release mechanisms used to create the sealing element. Specific parameters to be considered in determining when a sealing element should release will in the first instance depend upon such factors as the fusibility, size, and shape of the sealing element, differentials in thermal expansion coefficients of components used in the sealing element, the location of the element within the vent passageway, the location of the passageway entrance within the cylinder, and, to the extent that securing means not inherent to the physical device are used, the sealing characteristics of the securing means.

Figure 2:
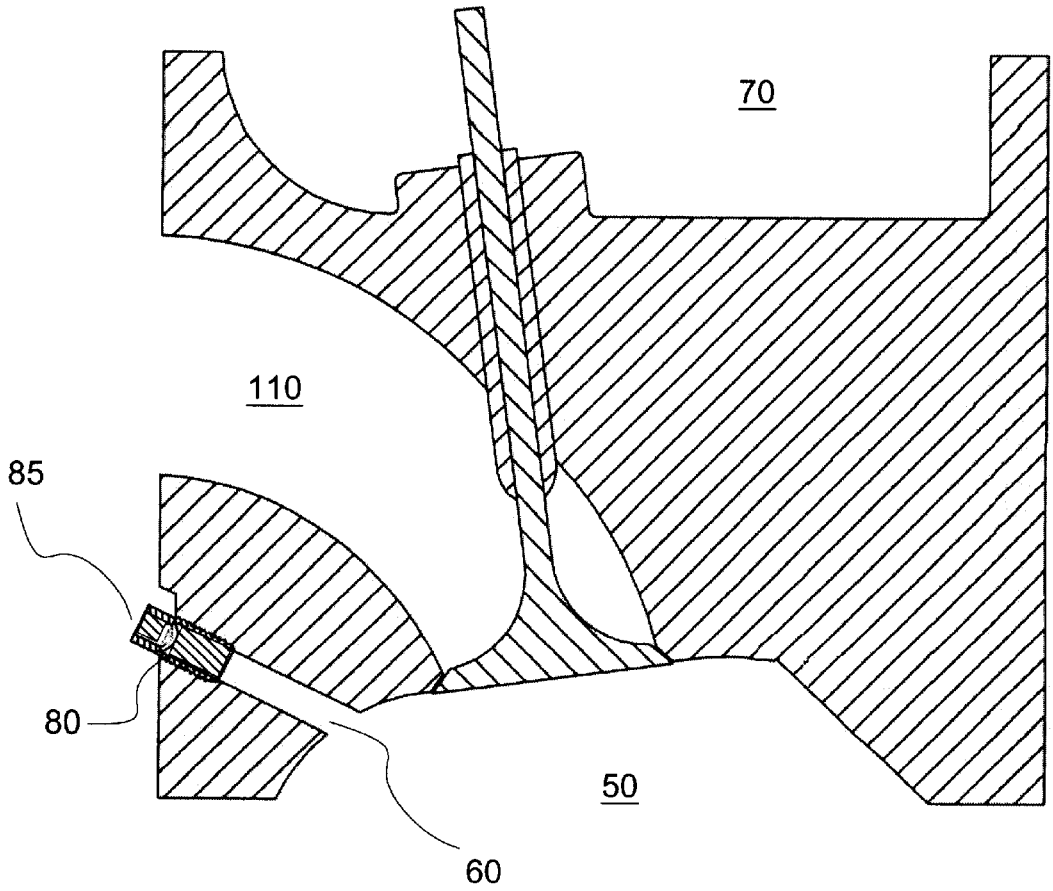
FIG. 2 is a sectional view illustrating an embodiment in which the vent passageway in a cylinder of a diesel engine extends through a portion of the cylinder head to the atmosphere.

FIG. 2 shows the top portion of a cylinder 50 of a diesel engine in which a vent passageway 60 extends through the cylinder head 70 to the ambient atmosphere. As depicted, the sealing element 80 is located within the first quarter of the length of the vent passageway near the external terminus of the passageway. When an engine design utilizes this positioning for a sealing element, it will be a relatively simple matter to replace the sealing element without the requirement of engine disassembly. A sealing element used in this location may be threaded, and could have a flat-sided cap or an indentation at the distal end for convenient insertion or removal using a wrench or screwdriver. Where the sealing element is to be glued, keyed, or press fit, locating it at or near the external terminus of the passageway permits installation of the element without the need for engine disassembly. In this embodiment, the temperature to which the sealing element is exposed will be a function of the length of the passageway and the dissipation of air and cylinder head temperature throughout that length. With such a configuration, it may be possible to use a threaded sealing element having an interior portion that releases at a somewhat cooler temperature than if the element were located close to the interior terminus of the passageway. However, many of the critical parameters will vary from engine to engine, and it is likely that empirical evidence will be most satisfactory for determining release parameters.

Figure 3:
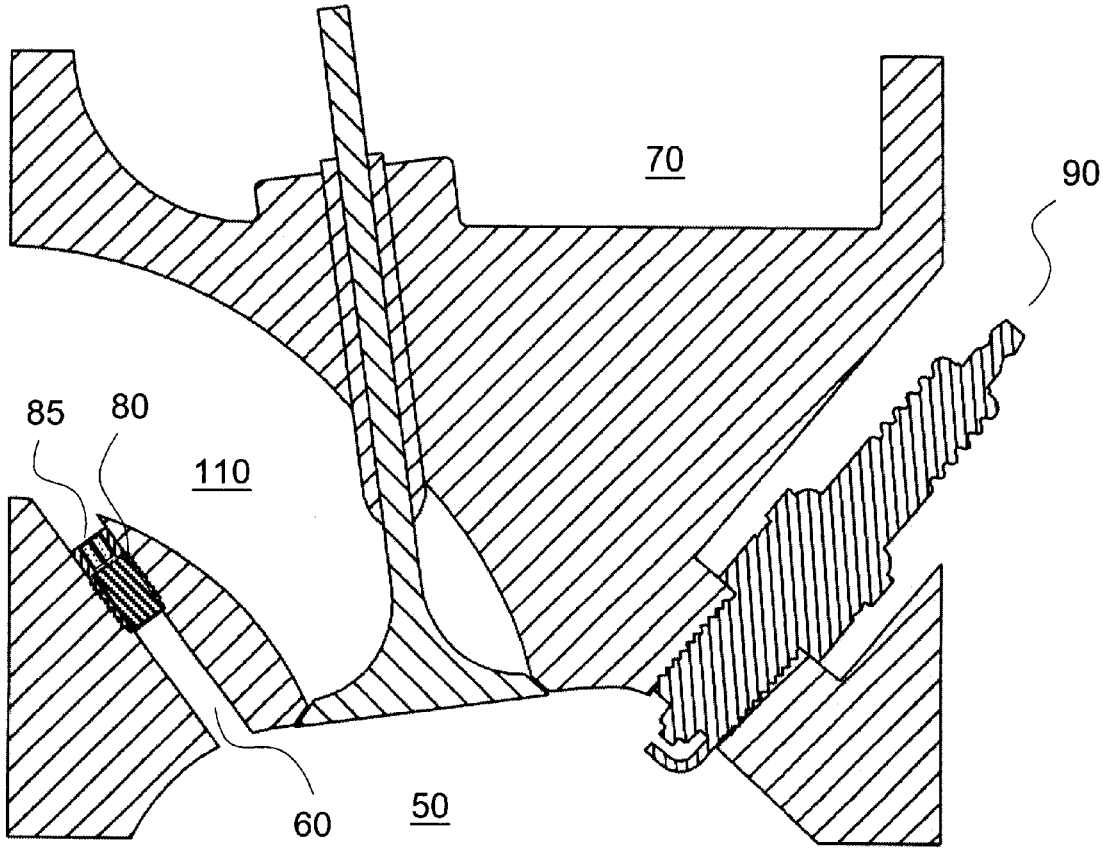
FIG. 3 is a sectional view showing an embodiment in which the vent passageway in a cylinder of a cylinder having a spark plug extends through a portion of the cylinder head to terminate at a point within the cylinder's exhaust port.

As shown in FIG. 3, the external terminus of the vent passageway 60 may be located within a portion of an engine cavity 110. In FIG. 3, the external terminus is located within an exhaust port 110 for the cylinder 50. As configured, the ejecta, including any material released from the sealing element, will be discharged into the exhaust port 110 for the cylinder where it may then be further carried and ultimately discharged through the vehicle's exhaust system.

Figure 4:
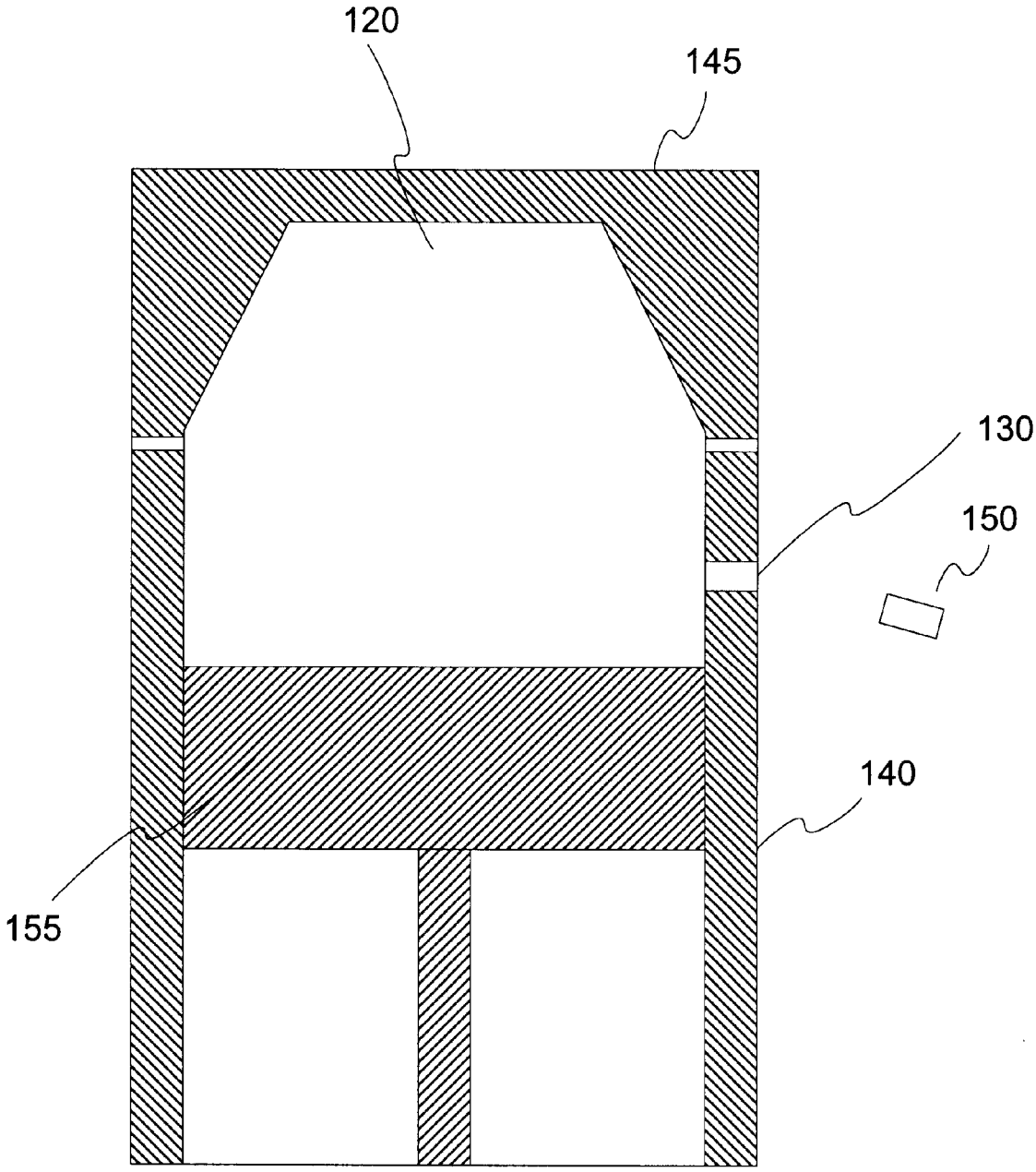
FIG. 4 shows an example of the release of a sealing element from a vent passageway located within the block of a diesel engine.

FIG. 4 depicts an example of a vent passage 130 through an engine block 140 in a cylinder 120 of a diesel engine. Although detonation and hydrolock are generally less prevalent in diesel engines, the damage that may result from those conditions may be considerable. The vent passageway 130 and sealing element 150 of this invention are equally applicable in diesel engines as they are to spark-initiated internal combustion engines. As with other embodiments, the placement of the internal and external termini of the vent passageway, and of the sealing element within the passageway, are matters of engineering design, and may be developed through empirical testing and theoretical analysis.

Figures 5A, 5B:
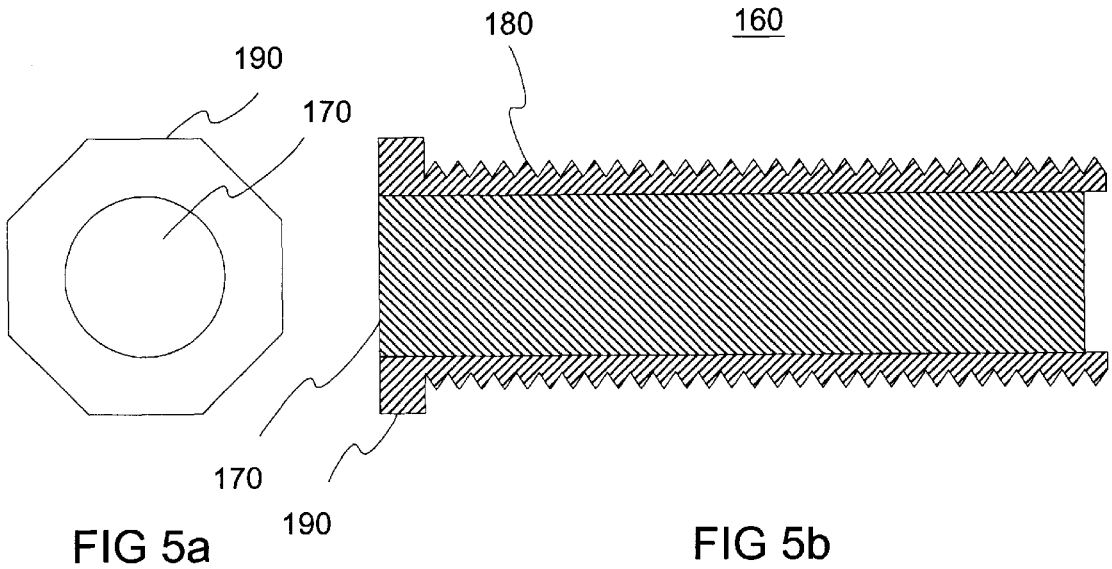
FIG. 5*a* is an elevational view of the distal end of a threaded two component sealing element suitable for installation using a wrench.
FIG. 5*b* depicts a sectional view of the sealing element of FIG. 5*a* showing the internal portion of the sealing element as being of one material while the outer portion is of a different material.

FIG. 5*a* is an end-on view of the distal end of a two-component sealing element. A thermally responsive material 170 is located within an interior channel surrounded by a threaded outer shell of a material having a different thermal response.

FIG. 5*b* shows the same sealing element in sectional view. This figure illustrates one embodiment of a threaded sealing element 160 in which the interior portion of the sealing element 170 is a temperature sensitive material having defined thermal characteristics, and is centrally located within an outer cylindrical annulus 180. The outer portion 180 is of a material having different thermal characteristics from the inner material. In this embodiment, the sealing element may be manufactured independently of the internal combustion engine in which it is to be installed, and may be specifically designed to release pressure under predetermined cylinder operating conditions. The outer portion 180 may be threaded to permit the installation of the sealing element simply by screwing the element into a threaded socket at the external terminus of the vent passageway. The sealing element has a head 190 which can be turned with a wrench to install the element into a passageway. The head 190 has a hollow central area extending around the inner material 170, which provides the inner material with a path from which it may be released from the sealing element to create a vent passageway.

In one release mode, the central portion 170 may become more fusible as its temperature rises, such that, upon encountering a maximum cylinder pressure the central portion deforms or melts. Increasing cylinder pressure causes the deformed material to be ejected through the hollow area in the head 190, causing a vent passageway through the sealing element.

In an alternative release mode, the inner and outer portions may have different coefficients of thermal expansion such that, upon encountering elevated temperatures, the outer portion 180 expands to a greater degree than the inner portion 170, thereby lowering the amount of friction holding the components together and permitting the inner portion to be ejected through the hollow area of the head 190 upon being subjected to cylinder pressure.

The frictional adhesion between the central and outer portions of the sealing element, and the release pressures as a function of temperature, may be precisely established, with the result that release pressures at varying temperatures may be established with a high degree of accuracy. When such parameters have been established, it will be possible to provide a range of "standard" sealing elements whose outer diameters can be of any practical dimension for use in vent passages of different diameters. In this embodiment, if the diameter of the central portion is kept constant, then the area of surface contact between the central and outer portions of the sealing element will remain constant, with the result that the release pressure and temperature parameters will remain essentially constant despite differences in the diameter of the passageway in which the sealing element is used, or in the outer diameter of the sealing element.

Combinations of these release modes, and other pressure and temperature-related means for releasing the sealing element known in the art may be used, and will remain within the scope of this invention. The instant invention has been shown and described herein in what is considered to be the most practical and preferred embodiment. It is recognized, however, that departures may be made herefrom within the scope of the invention and that obvious modifications will occur to a person skilled in the art. Accordingly, the embodiments and descriptions shown and provided herein are illustrative of the concepts for a pressure and temperature actuated pressure release element, and should not be taken as limiting the scope and spirit of the invention.

What is claimed is:

1. An apparatus for releasing excessive pressure from a cylinder of an internal combustion engine comprising:

a cylinder in an internal combustion engine;

a passageway having an internal terminus at an internal surface of said cylinder and extending through at least a portion of the material within which said cylinder is formed;

said passageway having an external terminus at a point exterior to said cylinder, the air pressure at said external terminus being lower than the maximum air pressure within said cylinder;

said passageway being hermetically sealed with a sealing element which is not part of a spark plug;

said sealing element being releasable to cause said passageway to form a vent passage between said internal terminus and said external terminus upon the occurrence in said cylinder of any one of a plurality of predetermined conditions of pressure and temperature.

2. The apparatus as claimed in claim 1, said material within which said cylinder is formed further comprising an engine block and said passageway extends through at least a portion of said engine block.

3. The apparatus as claimed in claim 2 further comprising said sealing element being located within the first one-quarter of the length of said passageway from said external terminus.

4. The apparatus as claimed in claim 2 further comprising said sealing element being located within said passageway near said internal terminus.

5. The apparatus as claimed in claim 1, said material within which said cylinder is formed further comprising a cylinder head and said passageway extends through at least a portion of said cylinder head.

6. The apparatus as claimed in claim 5 further comprising said sealing element being located within the first one-quarter of the length of said passageway from said external terminus.

7. The apparatus as claimed in claim 5 further comprising said sealing element being located within said passageway near said internal terminus.

8. An apparatus for releasing excessive pressure from a cylinder of an internal combustion engine comprising:

a cylinder in an internal combustion engine, said cylinder having internal surfaces formed by a material surrounding said cylinder;

a passageway extending through said material forming said cylinder and having an internal terminus at an internal surface of said cylinder and an external terminus at an area remote from said cylinder, the ambient pressure at said external terminus being lower than the maximum pressure within said cylinder;

a sealing element which is not part of a spark plug comprising a single component, said sealing element providing a hermetic seal in said passageway between said internal terminus and said external terminus when said sealing element is exposed to pressures and temperatures within a predetermined normal operating range;

said sealing element releasing to form a vent passageway between said internal terminus and said external terminus when said sealing element is exposed to pressures greater than said pressures within said predetermined normal operating range.

9. The apparatus of claim 8, said sealing element further comprising a temperature responsive material that will release said hermetic seal when said sealing element is exposed to temperatures greater than said temperatures within said predetermined normal operating range.

10. An apparatus for venting excessive cylinder pressure comprising:

a cylinder in an internal combustion engine;

a passageway having an internal entrance formed in an internal surface of said cylinder, said passageway extending between said cylinder and a region remote to said cylinder, the air pressure in said remote region being lower than the maximum pressure in said cylinder;

a sealing element which is not part of a spark plug within said passageway forming a hermetic seal when exposed to pressures and temperatures within a predetermined normal operating range;

said sealing element comprising a plurality of components, at least one of said plurality of components being releasable to create a vent passage in said passageway upon the exposure of said sealing element to any one of a plurality of predetermined conditions of pressure and temperature that exceed said predetermined normal operating range.

11. The apparatus as claimed in claim 10 further comprising said at least one component in said plurality of components being responsive to an increase in temperature such that the fusibility of said at least one component increases as said temperature increases.

12. The apparatus as claimed in claim 10 further comprising a first component in said plurality of components having a thermal expansion characteristic that is different from the thermal expansion characteristics of other components in said plurality of components, said differential in thermal expansion characteristics of said first component and said other components causing said first component to expand less than said other components upon an increase in temperature whereby relative movement occurs between said first component and said other components upon predetermined conditions of pressure and temperature.

13. The apparatus as claimed in claim 10 further comprising a first component in said plurality of components being affixed to at least one other component in said plurality of components with a temperature responsive adhesive substance, said substance having diminished adhesion characteristics as the temperature of said substance increases, said first component experiencing movement relative to said at least one other component upon predetermined conditions of pressure and temperature.

14. An apparatus for releasing excessive pressure from a cylinder of an internal combustion engine comprising:

a cylinder in an internal combustion engine, said cylinder having an internal surface formed by a cylinder head;

a passageway having a first terminus at said internal surface formed by a cylinder head and extending at least partially through said cylinder head, said passageway having a second terminus at a point remote to said cylinder, said second terminus being in an area of pressure that is lower than the maximum pressure in said cylinder;

a sealing element comprising a plurality of components, said sealing element having a threaded outer portion for mating engagement with a threaded internal portion of said passageway, at least a portion of said sealing element being located within one quarter of the length of said passageway from said second terminus, said sealing element releasing to form a vent passage in said passageway upon being exposed to any one of a plurality of predetermined conditions of pressure and temperature.

15. An apparatus as claimed in claim 14, a first component in said plurality of components further comprising a fusible material whose fusibility increases with increasing temperature.

16. An apparatus as claimed in claim 14 further comprising a first component in said plurality of components, said first component having a coefficient of thermal expansion that is different from the coefficients of thermal expansion of other components in said plurality of components, said first component being movable relative to said other components upon exposure to one of a plurality predetermined conditions of pressure and temperature.

17. A method of releasing excessive pressure from a cylinder of an internal combustion engine comprising the steps of:

creating a passageway between the cylinder of an internal combustion engine and a region having a pressure that is substantially lower than the peak pressures normally developed in said cylinder, said vent passageway being formed by and extending through at least a portion of the material forming said cylinder;

sealing said vent passageway with a threaded sealing element which is not part of a spark plug;

releasing said sealing element to form a vent passage in said passageway upon the exposure of said sealing element to one of a plurality of predetermined conditions of pressure and temperature.

18. A method of releasing pressure from a cylinder of an internal combustion engine comprising the steps of:

creating a passageway between the cylinder of an internal combustion engine and a region of ambient air pressure, said passageway extending through at least a portion of the material forming said cylinder;

inserting a sealing element which is not part of a spark plug in said passageway;

securing said sealing element in said passageway with a temperature responsive adhesive substance;

releasing said sealing element to form a vent passage in said passageway upon the exposure of said sealing element to one of a plurality of predetermined conditions of temperature and pressure.

19. A method of releasing pressure from a cylinder of an internal combustion engine comprising the steps of:

creating a passageway from a cylinder of an internal combustion engine to a region external to said engine, said passageway passing through the material forming said cylinder;

inserting a sealing element which is not part of a spark plug having a key into said passageway to seal said passageway;

securing said sealing element within said passageway by engaging said key with a mating key receptacle within said passageway;

releasing said sealing element upon exposure of said sealing element to one of a plurality of predetermined conditions of pressure and temperature.

20. A method of releasing excessive pressure from a cylinder of an internal combustion engine comprising the steps of:

creating a cylinder having internal surfaces formed from an engine block and a cylinder head;

creating an air passageway extending from one of said internal surfaces of said cylinder to a region of ambient air pressure;

sealing said air passageway with a sealing element which is not part of a spark plug;

securing said sealing element within said passageway by a press fitting between said sealing element and said air passageway;

releasing said sealing element to form a vent passage within said air passageway when said sealing element is exposed to one of a plurality of predetermined conditions of temperature and pressure.

21. A method of releasing excessive pressure from a cylinder of an internal combustion engine comprising the steps of:

creating a vent passageway between the cylinder of an internal combustion engine and a region having a pressure that is substantially lower than the peak pressures normally developed in said cylinder, said vent passageway extending through at least a portion of the material forming said cylinder;

sealing said vent passageway with a sealing element which is not part of a spark plug;

releasing said sealing element from said vent passageway when abnormal cylinder operating conditions are encountered.

22. The method of claim 21 wherein said step of releasing said sealing element comprises the further step of applying sufficient pressure to said sealing element to force at least a portion of said sealing element to be expelled from said vent passageway.

23. The method of claim 22 wherein said step of releasing said sealing element comprises the further step of raising the temperature of said sealing element to cause at least a portion of said sealing element to be weakened.

24. A sealing element for sealing a vent passageway for a cylinder of an internal combustion engine comprising:

a temperature sensitive portion having thermal characteristics responsive to an increase in the temperature of said temperature sensitive portion;

means for securing said sealing element within a vent passageway that is not a receptacle for a spark plug;

such that, upon an increase in the temperature of said temperature sensitive portion and an increase of internal cylinder pressure, said sealing element will deform to form a vent passageway to release said internal cylinder pressure.

25. A sealing element for sealing a vent passageway for a cylinder of an internal combustion engine comprising:

a first temperature sensitive component having first expansion characteristics responsive to an increase in the temperature of said first temperature sensitive component;

a second temperature sensitive component having at least a portion of its surface in contact with the surface of said first temperature sensitive component, said second temperature sensitive component having second expansion characteristics responsive to an increase in the temperature of said second temperature sensitive component;

said first expansion characteristics of said first temperature sensitive portion being different from said second expansion characteristics of said second temperature sensitive portion;

means for securing said sealing element within a vent passageway that is not a receptacle for a spark plug;

said first and said second temperature sensitive components expanding by different amounts upon an increase in temperature to cause a decrease in the surface friction at their contacting surfaces;

said sealing element releasing one of said temperature sensitive components upon being exposed to one of a plurality of predetermined conditions of temperature and pressure.

* * * * *